US006065508A

United States Patent [19]

Ball et al.

[11] Patent Number: 6,065,508

[45] Date of Patent: May 23, 2000

[54] FILLER PRODUCT SUPPLY APPARATUS AND METHOD

[75] Inventors: Joseph F. Ball; Michael Mihalik, both of Munroe Falls; Michael A. Davis, Ravenna, all of Ohio

[73] Assignee: Pneumatic Scale Corporation, Cuyahoga Falls, Ohio

[21] Appl. No.: 09/187,962

[22] Filed: Nov. 6, 1998

[51] Int. Cl.[7] ..... B65B 1/04

[52] U.S. Cl. ..... 141/67; 141/129; 141/145

[58] Field of Search ..... 141/67, 129, 144, 141/145

[56] References Cited

U.S. PATENT DOCUMENTS 2,528,644 11/1950 Dunn .
2,848,019 8/1958 Corbin et al. .
3,087,517 4/1963 Magnuson et al. .
3,311,140 3/1967 Hughes .
3,324,905 6/1967 Paulo .
3,464,464 9/1969 Laub .
3,656,517 4/1972 Taylor et al. .
3,892,264 7/1975 Held .
4,258,759 3/1981 Achen .
4,489,769 12/1984 Catelli .
4,893,660 1/1990 Berg et al. .
5,022,443 6/1991 Warner .
5,111,857 5/1992 LaWarre, Sr. .

*Primary Examiner*—Steven O. Douglas
*Attorney, Agent, or Firm*—Daniel D. Wasil; David R. Percio

[57] ABSTRACT

A filler product supply apparatus (10) and method has one or more conduits (17) for delivering filler product under pressure to a manifold (30). Filler product is delivered through manifold (30) to one or more filling heads (18, 28) integral with the manifold. The filling heads (18, 28) deliver the filler product directly from the manifold into containers.

20 Claims, 9 Drawing Sheets

FILLER PRODUCT SUPPLY APPARATUS AND METHOD

TECHNICAL FIELD

This invention relates to a filler product supply apparatus and method. More specifically this invention relates to a filler product supply apparatus and method for a sanitary, self draining system having filling heads integral to a manifold, and which is capable of high speed wash down and clean-in-place operation.

BACKGROUND ART

Bottles and other containers for filler products, particularly liquids, have generally been filled in high volume operations through a filler assembly. The filler assembly has a number of fill heads which sequentially deliver liquid to a number of containers until a selected fill level, volume or weight has been reached in each container. The filled containers are replaced with empty containers on a continuing basis on a rotary filler and the process is repeated.

The liquid is delivered from a product supply source to a manifold or to an intermediate on board tank and thereafter through hoses from the manifold or tank to each filling head. These systems are generally either gravity fed or operate at low pressures in the range of one to two pounds per square inch ("psi"). It has been difficult to operate at higher pressures because of the volume of the intermediate tank in those systems having a tank. It has also been difficult to clean in place and wash down because of the number of filling hoses, and additionally because of the size of the intermediate tank in those systems having a tank.

Sanitary systems, particularly those in which the filler products are foods, personal care products or pharmaceuticals, must be operated in a way in which microbial and other contaminants are removed from the system before the product is introduced. Also, contaminants must be prevented from entering after the product is introduced. Systems having more parts and components are naturally more difficult to remove contaminants from effectively than are systems with fewer parts. Operating a system in a non-pressurized or gravity feed mode risks introduction of contaminants during operation.

Thus there exists a need for a sanitary, self-draining product supply apparatus and method which permits quick, efficient and convenient cleaning and pressurized operation having fewer parts than existing systems.

DISCLOSURE OF INVENTION

It is an object of the present invention to provide a filler product supply apparatus and method for a sanitary, self-draining system.

It is a further object of the present invention to provide a filler product supply apparatus and method for a sanitary, self-draining system having filling heads integral to a manifold.

It is a further object of the present invention to provide a filler product supply apparatus and method for a sanitary, self-draining system which is capable of high speed wash down and clean-in-place operation.

It is a further object of the present invention to provide a filler product supply apparatus and method for a sanitary, self-draining system which may be operated at pressures of up to 25 psi.

The foregoing objects are accomplished in a preferred embodiment of the invention by an apparatus and method for carrying out the method which utilizes a continuous manifold with the filling heads integral to the manifold.

Further objects of the present invention will be made apparent in the following Best Mode For Carrying Out Invention and the appended claims.

BEST MODE FOR CARRYING OUT INVENTION

Figure 1:
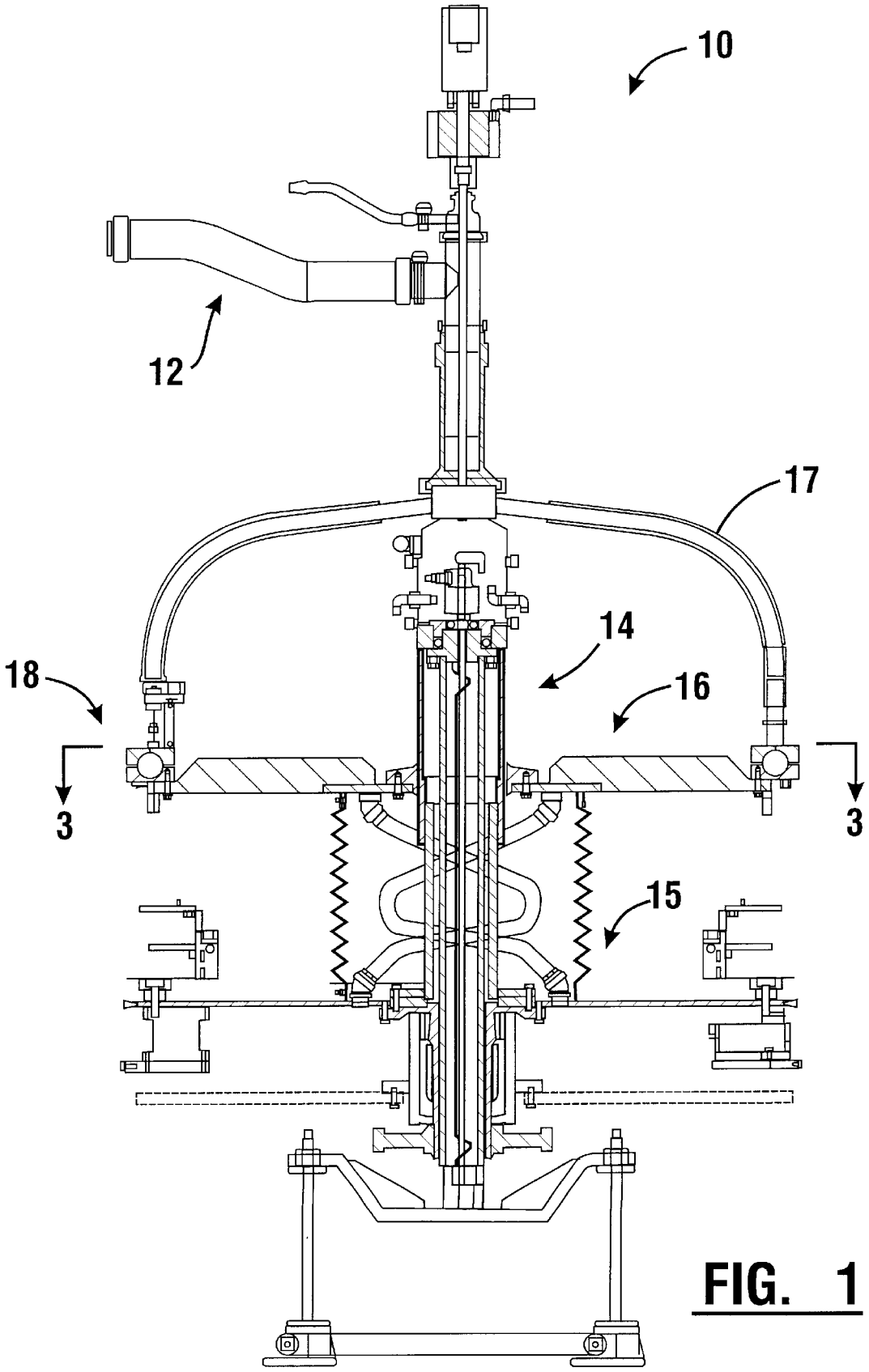
FIG. 1 is a cross-sectional view of one embodiment of the present invention having liquid net weight filling heads.

A preferred embodiment of the invention is shown in FIG. 1. A filler product supply apparatus 10 has a product supply portion 12, a center column portion 14, a lower turret 15 and an upper turret 16. The product supply portion 12, a center column portion 14 and a lower turret 15 are well known in the prior art. Product supply portion 12 supplies filler product from a reservoir (not shown) of filler product. Filler product is supplied in the preferred embodiment under pressure, preferably up to 25 psi.

Center column portion 14 is in supporting relation with a lower turret 15. Filler product is introduced through liquid net weight filling heads 18 into containers (not shown) supported on lower turret 15. Filled containers are replaced by empty containers for the next filling cycle. This is a well known filling operation.

Figure 3:
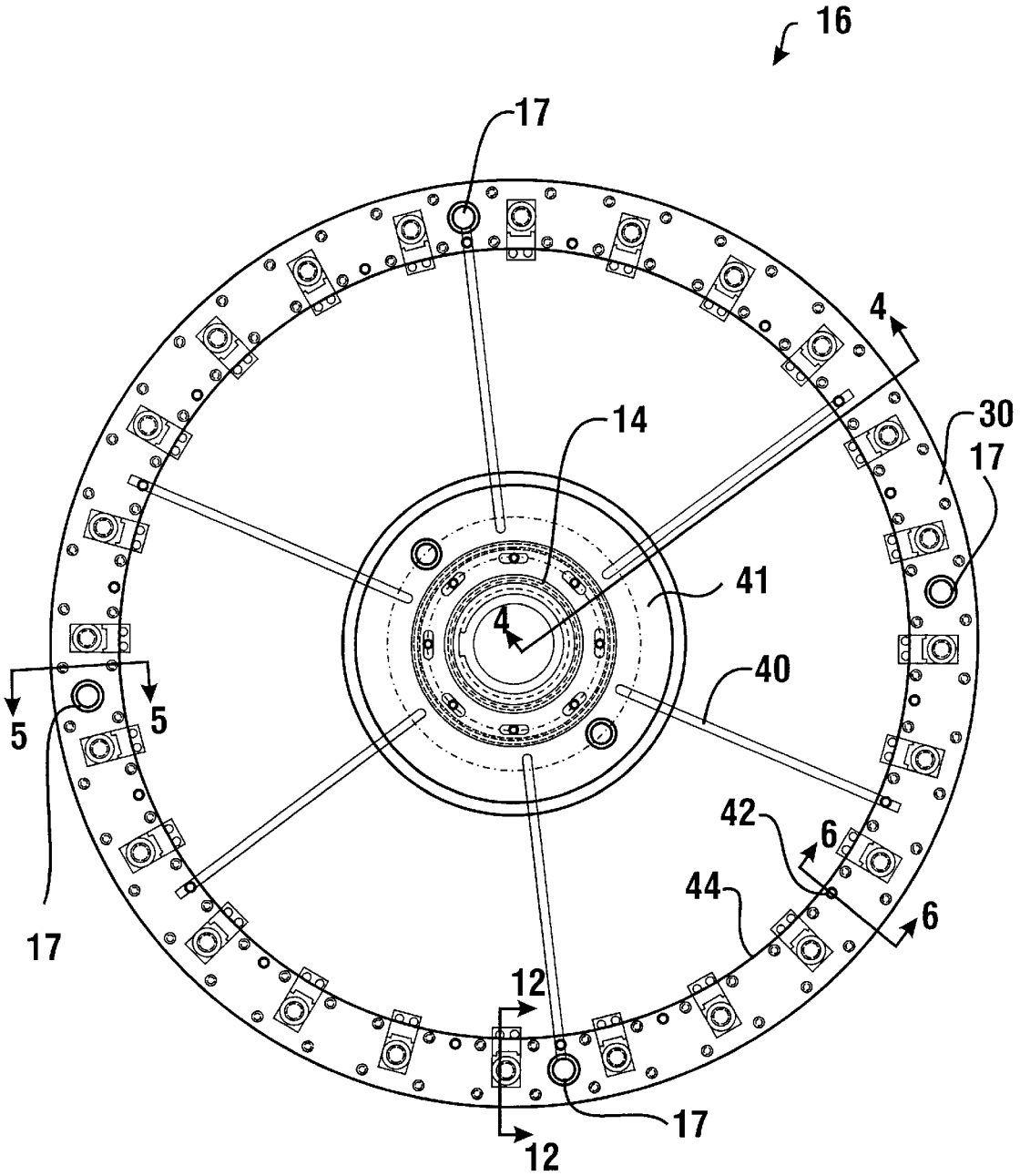
FIG. 3 is a plan view of an upper turret assembly shown along line 3—3 shown in FIGS. 1 and 2.

In the preferred embodiment shown in FIG. 1 filler product flows through supply portion 12 to upper turret 16 through one or more conduits 17. A plan view of upper turret 16 of a preferred embodiment shown in FIG. 1 is shown in FIG. 3. Four conduits 17, which are hoses in this embodiment, are located equidistant from each adjacent conduit. Upper turret 16 further includes a plurality of filling heads 18, a manifold 30, a plurality of spokes 40 and risers 42, and a filling head support ring 44. Upper supply portion 12 and manifold 30 are in liquid communication through conduit 17.

In this embodiment manifold 30 is generally circular in plan view for use in a rotary filling application. However, it should be understood that manifold 30 could be any shape, including being linear in plan view for use in in-line filling applications.

Figure 4:
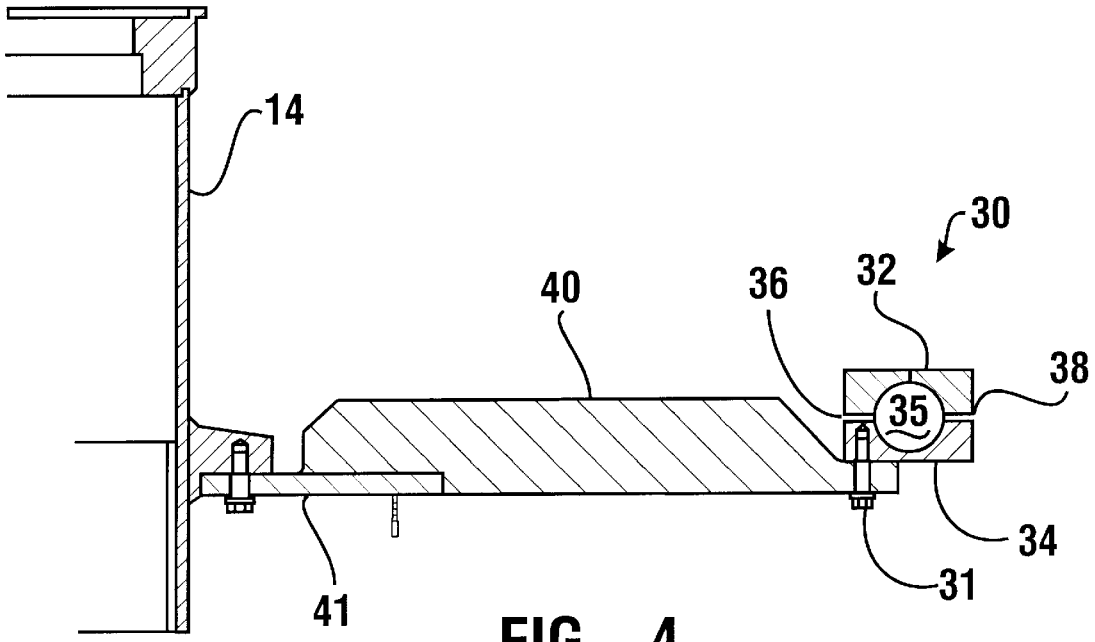
FIG. 4 is a cross-sectional view of a spoke and the manifold shown along line 4—4 in FIG. 3.

A cross-sectional view of a spoke 40 is shown in FIG. 4. In this embodiment there is a spoke 40 and hub 41 arrangement supporting a manifold 30. Hub 41 is in supported connection with center column 14. Hub 41 is preferably bolted to center column 14, but any other convenient attachment means may be used. Six spokes 40 are located equidistant from each adjacent spoke. Each spoke has a first end in fixed supported connection with hub 41. Spokes 40 are preferably welded to hub 41, but they may be bolted or attached by any other convenient attachment means. Each spoke 40 has a second end in supporting connection with manifold 30. In this embodiment manifold 30 is in bolted connection with spokes 40, but other attachment means such as welding may be used. Thus manifold 30 is in supported connection with center column 14.

Figure 5:
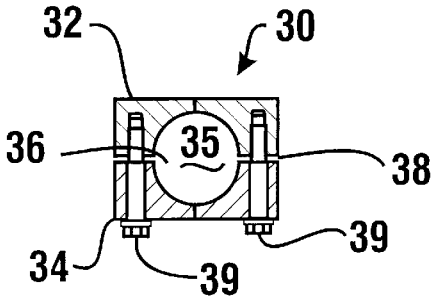
FIG. 5 is a cross-sectional view of the manifold shown along line 5—5 in FIG. 3.
Figure 6:
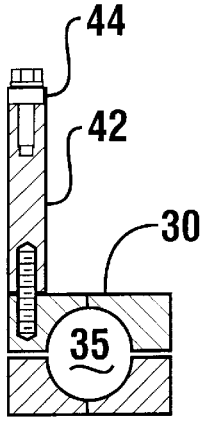
FIG. 6 is a cross-sectional view of a riser and the manifold shown along line 6—6 in FIG. 3
Figure 7:
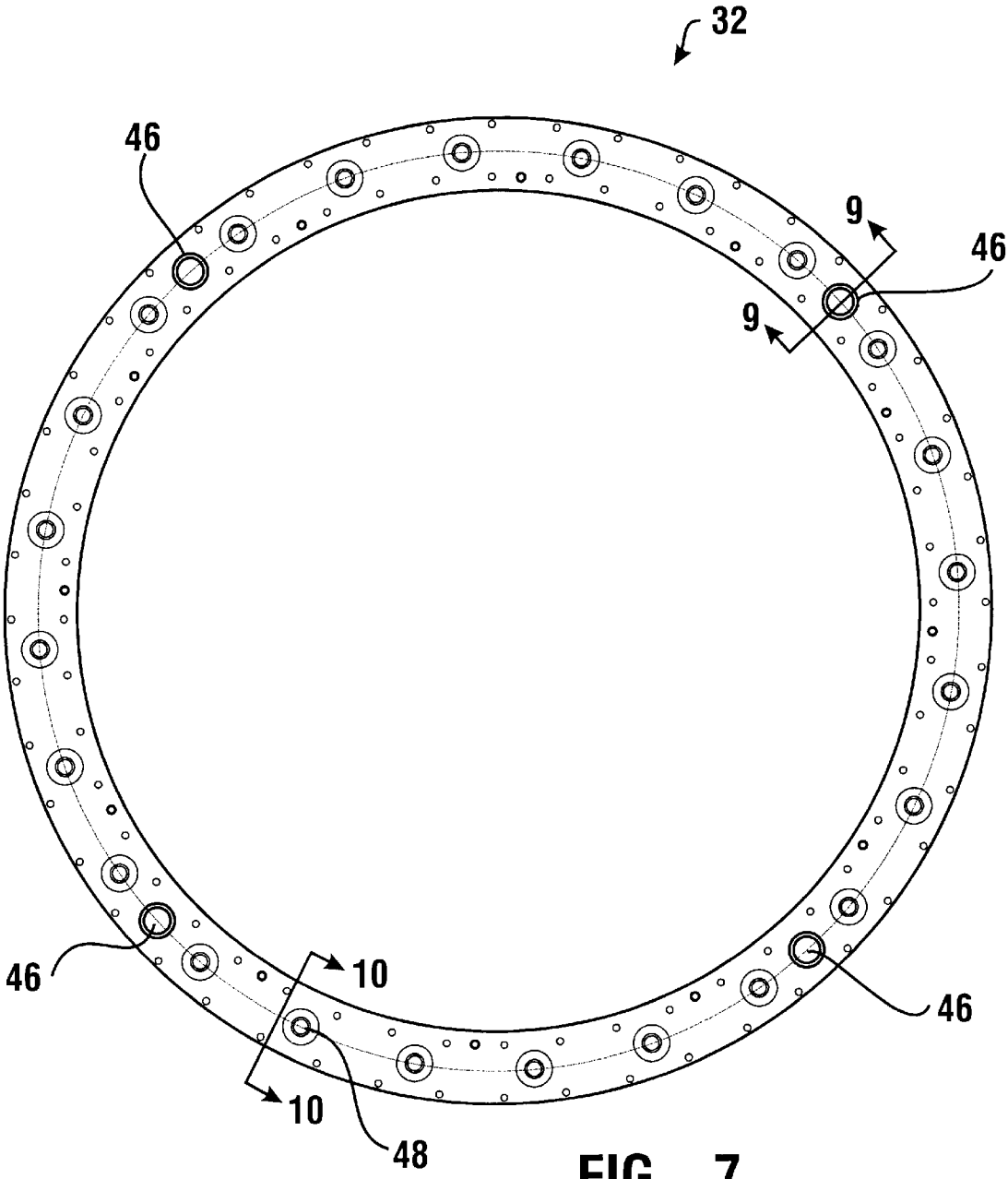
FIG. 7 is a plan view of the upper section of the manifold shown in FIG. 3.
Figure 8:
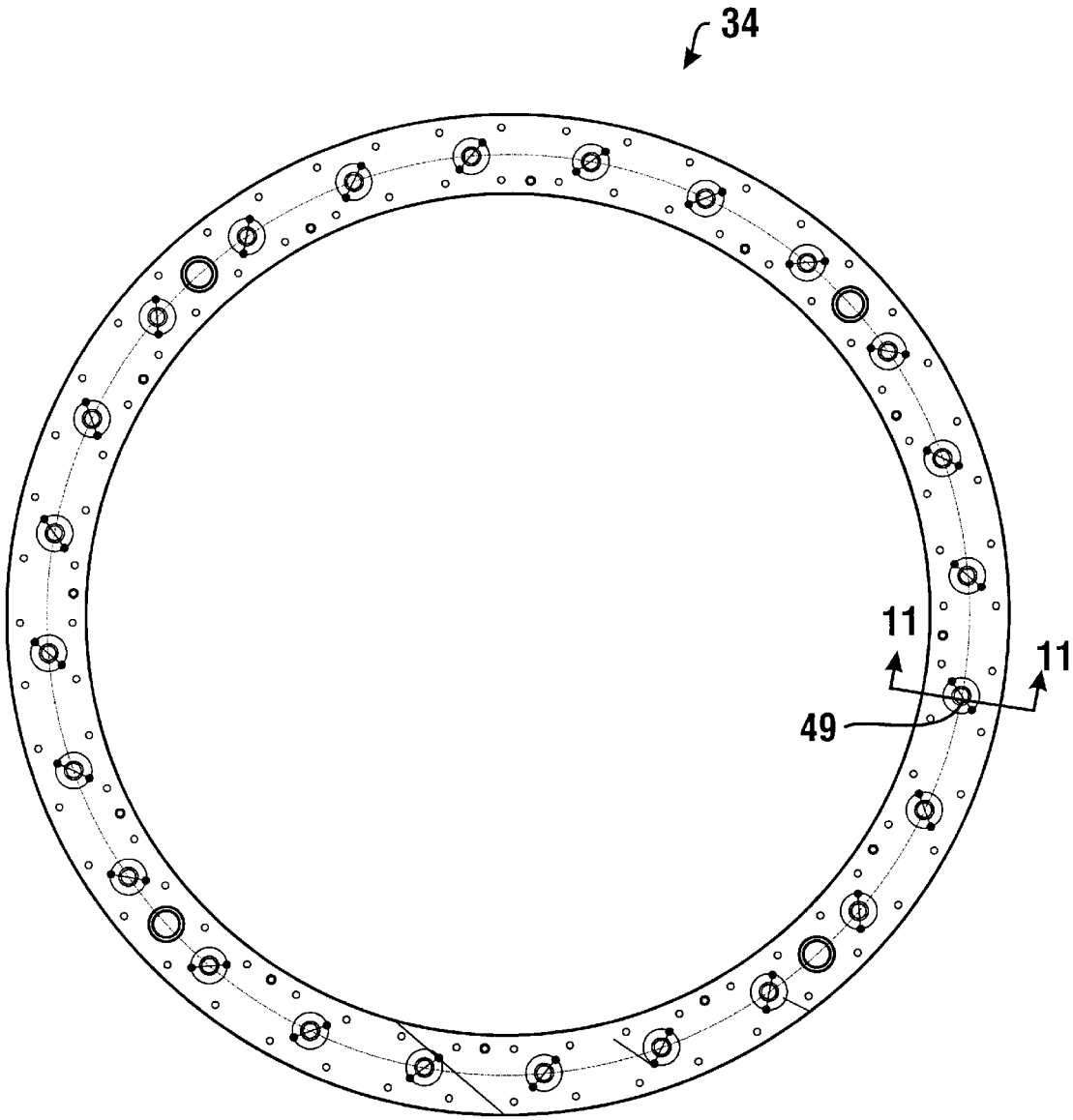
FIG. 8 is a plan view of the lower section of the manifold shown in FIG. 3.

FIGS. 4, 5 and 6 show cross-sectional views of manifold 30. FIG. 7 shows a plan view of a manifold upper section 32 and FIG. 8 shows a plan view of a manifold lower section 34. Manifold 30 comprises an upper section 32 and a lower section 34. Upper section 32 and a lower section 34 are each rectangular in cross-section and have a semi-circular groove. The grooves in upper section 32 and lower section 34 correspond so that the open groove sides align to form circular cross-section chamber 35 through manifold 30. Chamber 35 may have other cross-sectional shapes in other embodiments. In this embodiment upper section 32 and lower section 34 are machined from stainless steel. Manifold 30 is mechanically connected to each spoke 40 with a bolt 31, although welding or any other convenient attachment means may be used.

An inner gasket 36 and an outer gasket 38 are compressed between manifold upper section 32 and lower section 34 to provide a liquid-tight pressure seal. In this embodiment inner gasket 36 and outer gasket 38 are rectangular in cross-section and are made from Viton®, a material approved by the U.S. Food and Drug Administration for sanitary applications. The rectangular cross-section of inner gasket 36 and outer gasket 38 results in a flat gasket. A flat gasket will not be a microbial trap thereby enhancing the sanitary characteristics of the apparatus. Manifold upper section 32 and lower section 34 are drawn together by a plurality of bolts 39 thereby compressing inner gasket 36 and outer gasket 38. Chamber 35 is formed, bounded by the upper and lower sections 32, 34 and the inner and outer gaskets 36, 38. Bolted connections are preferably made with bolts 39 from below through a lower into threaded holes in an upper section. In this way fewer contaminants accumulate and wash down is more effective. However, bolts 39 may be placed from the top, or alternative fasteners may be used.

FIG. 6 further shows riser 42 in supported connection with manifold 30. Riser 42 is in supporting connection with a filing head support ring 44. Ring 44 supports an upper portion of filling heads 18. Riser 42 is preferably bolted to manifold 30 and ring 44 is preferably bolted to riser 42, but other convenient attachment means may be used.

Figure 9:
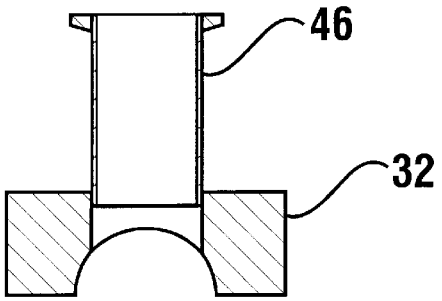
FIG. 9 is a cross-sectional view of a conduit coupling and the upper manifold section shown along line 9—9 in FIG. 7.

FIG. 9 shows a cross-sectional view of a conduit coupling 46. Conduit coupling 46 has a first end which penetrates through manifold upper section 32. Conduit coupling 46 has a second end to which a conduit 17 may be mechanically connected for communication of filler product from filler product supply 12 through conduit 17 into manifold chamber 35.

Figure 10:
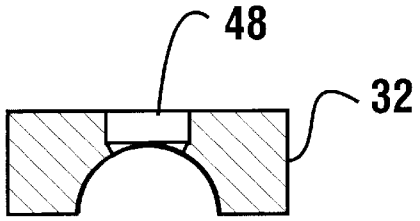
FIG. 10 is a cross-sectional view of a filling head aperture and the upper manifold section shown along line 10—10 in FIG. 7.
Figure 11:
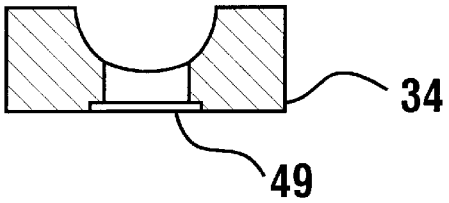
FIG. 11 is a cross-sectional view of a filling head aperture and the lower manifold section shown along line 11—11 in FIG. 8.
Figure 12:
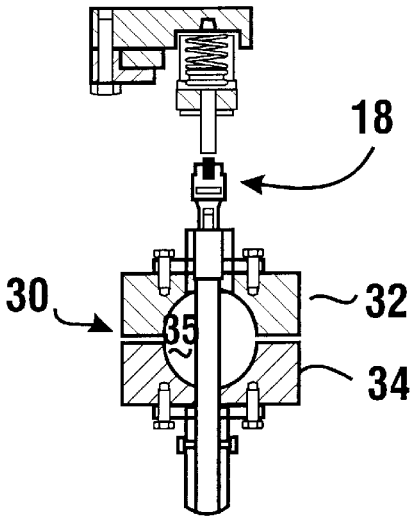
FIG. 12 is a cross-sectional view of a filling head and the manifold along line 12—12 in FIG. 13.

FIGS. 10 and 11 show a filling head upper aperture 48 and a filling head lower aperture 49 respectively. Manifold upper section 32 and lower section 34 are aligned so that apertures 48 and 49 are aligned to accommodate filling heads 18, 28. Shown in FIG. 12 is an elevational view of a filling head 18 with a cross-sectional view of manifold 30. Filling head 18 passes through apertures 48, 49.

Figure 13:
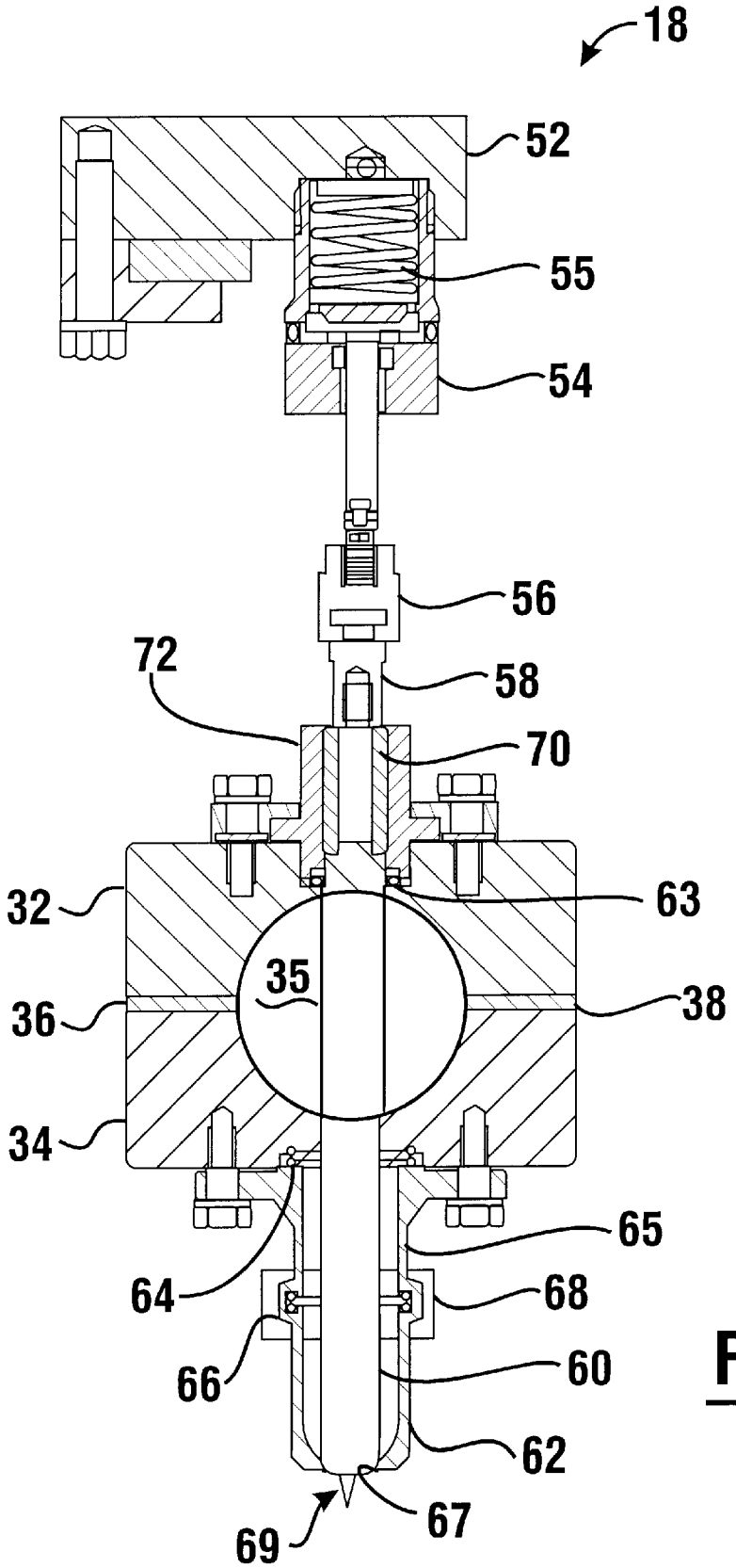
FIG. 13 is a cross-sectional view of a liquid net weight filling head of the embodiment shown in FIG. 1.
Figure 14:
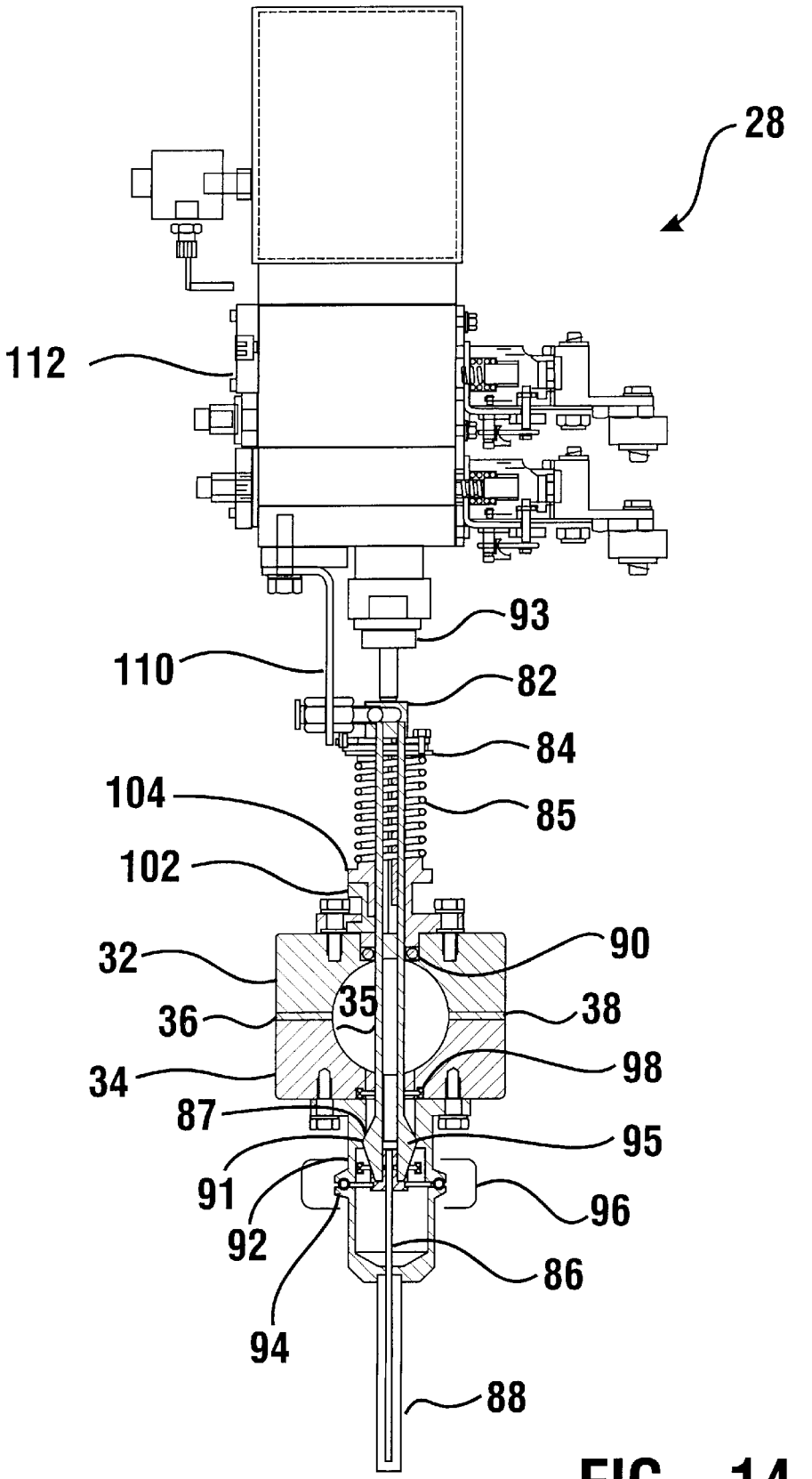
FIG. 14 is a cross-sectional view of a level sensing filling head of the embodiment shown in FIG. 2.

A liquid net weight filling head 18 is shown in cross-section in FIG. 13. An air cylinder manifold 52 and an air cylinder 54 cooperate with first alignment compensator 56 and a second alignment compensator 58 to actuate inner nozzle 60 to release filler product through outer nozzle 62. Alternatively a solenoid could be used to actuate inner nozzle 60 to release filler product through outer nozzle 62.

Outer nozzle mounting 65 is attached in supported relation with manifold lower section 34, preferably by bolts, although other attachment means may be used. An outer nozzle mounting seal 64 is compressed between outer mounting 65 and manifold lower section 34. A gasket 66 is compressed between a first end of outer nozzle 62 and outer nozzle mounting 65. Gasket 66 is preferably a sanitary gasket, similar or equivalent in composition to gaskets 36, 38. A first end of outer nozzle 62 is releasably connected to outer nozzle mounting 65 with gasket 66 therebetween by a clamp 68. Preferably clamp 68 is quick disconnect clamp of the type to permit toolless changes of nozzles and gaskets. A second end of outer nozzle 62 has an orifice 69. Orifice 69 may be sized to regulate the desired filler product flow.

Filler product is pressurized, preferably up to 25 psi, in chamber 35 and in the space between the outside surface of inner nozzle 60 and the inside surface of outer nozzle 62. Filler product is prevented from leaking by inner nozzle seal 63 and outer nozzle mounting seal 64, which are preferably sanitary seals, manifold inner gasket 36 and outer gasket 38, nozzle mounting gasket 66 and a nozzle sealing surface 67. Inner nozzle seal 63 is preferably a dynamic reciprocating silicone filled Teflon® seal to maintain a seal as inner nozzle 60 moves back and forth. Outer nozzle mounting seal 64 and nozzle mounting gasket 66 are preferably Viton® or a comparable food grade gasket approved by the U.S. Food and Drug Administration. Nozzle sealing surface 67 is formed by a precise fit of the end portion of the outer surface of inner nozzle 60 and the end portion of the inner surface of outer nozzle 62.

Inner nozzle 60 is held in alignment by nozzle bushing 70. Nozzle bushing 70 moves coaxially inside manifold upper ring bushing 72. Manifold upper ring bushing 72 is held in fixed mechanical attachment with manifold upper ring 32. Alignment compensators 56, 58 prevent wear on inner nozzle seal 63 which could occur due to misalignment.

Until it is desirable to release filler product into the container, inner nozzle 60 is pressed against nozzle sealing surface 67 by the force exerted by spring 55. Alternatively air pressure may be used directly rather than to compress a spring. When it is desirable to release filler product into the container, air from air cylinder manifold 52 is released into air cylinder 54. The force of spring 55 is overcome and inner nozzle 60 is pulled back from nozzle sealing surface 67. Filler product under pressure is released into the container. When sufficient filler product has been released, air is no longer supplied to air cylinder 54 and the force of spring 55 moves inner nozzle 60 back into contact with nozzle sealing surface 67 to stop the flow of filler product. Filled containers are replaced by empty containers for the next filling cycle. This is a well known filling operation.

Figure 2:
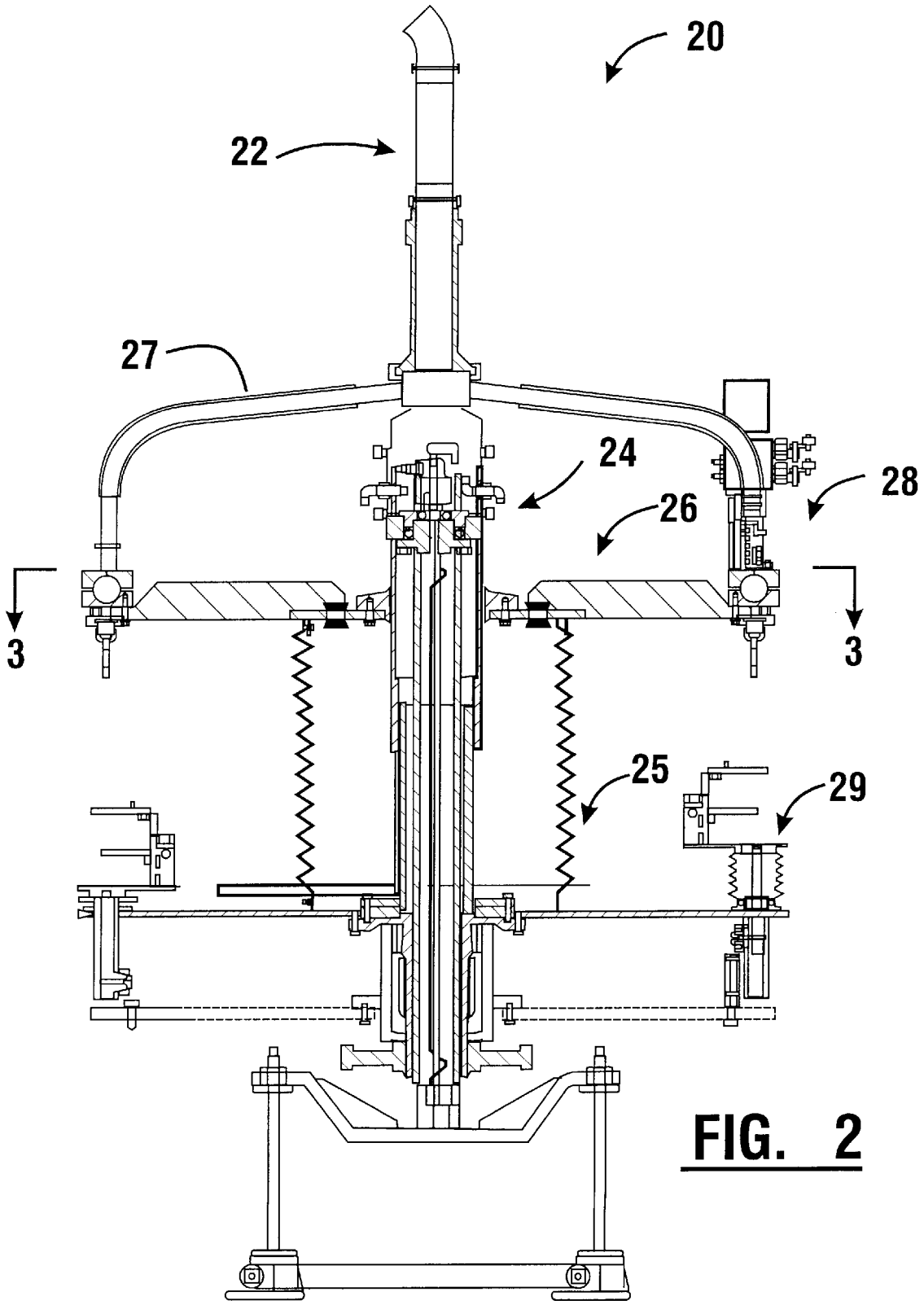
FIG. 2 is a cross-sectional view of one embodiment of the present invention having level sensing filling heads.

Other filling heads may be used in combination with manifold 30 in a filler product supply apparatus of the present invention. For example, a filler product supply apparatus 20 is shown in FIG. 2. Filler product supply apparatus 20 has a product supply portion 22, a center column portion 24, a lower turret 25 and upper turret 26. The product supply portion 22, a center column portion 24 and a lower turret 25 are well known in the prior art. Product supply portion 22 supplies filler product from a reservoir (not shown) of filler product. As with the first preferred embodiment, filler product in this embodiment is supplied under pressure, preferably up to 25 psi.

Center column portion 24 is in supporting relation with a lower turret 25. Filler product is introduced through level sensing filling heads 28 into containers (not shown) supported on lower turret 25. A lift platform 29 is supported on lower turret 25. Lift platform 29 reciprocates between a filling position in which filler product is introduced into the containers through level sensing filling heads 28 and a retracted position at which the filled containers are replaced by empty containers for the next filling cycle. Lift platform 29 moves upward to position the container so that filler product is introduced first at the bottom of the container. Filled containers are replaced by empty containers for the next filling cycle. This is a well known filling operation.

In the preferred embodiment shown in FIG. 2 filler product flows through supply portion 22 to upper turret 26 through one or more conduits 27. A plan view of upper turret 26 of a preferred embodiment shown in FIG. 2 is shown in FIG. 3. Four conduits 27, which are hoses in this embodiment, are located equidistant from each adjacent conduit. Upper turret 26 further includes a plurality of filling heads 28, a manifold 30, a plurality of spokes 40 and risers 42, and a filling head support ring 44. Upper supply portion 22 and manifold 30 are in liquid communication through conduit 27. Upper turret 26 elements including manifold 30, spokes 40, risers 42 and filling head support ring 44 are as shown in FIGS. 3–6 and described above.

In this embodiment manifold 30 is generally circular in plan view for use in a rotary filling application. However, it should be understood that manifold 30 could be any shape, including being linear in plan view for use in in-line filling applications.

A bushing 102 in supported relation with manifold upper section 32 cooperates with a nozzle bushing 104 to hold an upper portion of an inner nozzle holder 95 in alignment. A lower portion of inner nozzle holder 95 is in supporting relation with inner nozzle 86. A cap 82 and a spring guide 84 cooperate to hold a spring 85 in surrounding aligned relation with an upper portion of inner nozzle holder 95.

An outer nozzle mounting 92 is attached in supported relation with manifold lower section 34, preferably by bolts, although other attachment means may be used. An outer nozzle mounting gasket 98 is compressed between outer nozzle mounting 92 and manifold lower section 34. An outer nozzle 88 is attached in supported relation with outer nozzle mounting 92. An outer nozzle gasket 94 is compressed between an upper end of outer nozzle 88 and a lower end outer nozzle mounting 92. Outer nozzle 88 is releasably connected to outer nozzle mounting 92 with gasket 94 therebetween by a clamp 96. Preferably clamp 96 is a quick disconnect clamp of the type to permit toolless changes of nozzles and gaskets.

Filler product is pressurized, preferably up to 25 psi, in chamber 35. Filler product is prevented from leaking from chamber 35 by inner nozzle seal 90 manifold inner gasket 36 and outer gasket 38, outer nozzle mounting gasket 98, outer nozzle gasket 94 and an outer nozzle sealing surface 87. Inner nozzle seal 90 is preferably a dynamic reciprocating silicone filled Teflon® seal to maintain a seal as inner nozzle 86 moves back and forth. Outer nozzle mounting gasket 98 is preferably Viton® or a comparable food grade gasket approved by the U.S. Food and Drug Administration. Nozzle sealing surface 87 is formed by a precise fit between an inner nozzle holder 95 and an inner surface 91 of outer nozzle mounting 92.

A control box 112 mounted on a bracket 110, preferably an anti-rotation bracket, is in operative connection with an air cylinder 93. Air cylinder 93 is aligned with cap 82. Until it is desirable to release filler product into the container the spring force of spring 85 acts to hold inner nozzle holder 95 in sealing relation with an outer nozzle sealing surface 91. Air cylinder 93 in response to a signal from control box 112 acts downwardly on cap 82 thereby compressing spring 85. Inner nozzle holder 95 and inner nozzle 86 are moved downwardly to release filler product through outer nozzle 88.

A low pressure air flow is provided through inner nozzle 86 as a sensing signal. When the rising filler product reaches the tip of inner nozzle 86, the low pressure air flow is closed by the filler product and a back pressure is created. This back pressure activates a valve (not shown) causing air cylinder 93 to move upwardly, whereupon the force of spring 85 moves nozzle sealing surface 87 into sealing relation with outer nozzle sealing surface 91 to stop the flow of filler product. Lift platform 29 retracts and the filled container is replaced by an empty container.

Other filling heads may also be used in combination with manifold 30 in a filler product supply apparatus of the present invention. The number of filling heads, the number of conduits 17 and the number of spokes 40 may be increased or decreased from those shown in the preferred embodiments described above. Additionally, manifold 30 has been shown and described as a circular in shape forming an annulus, but it may be any shape, including a straight line for in-line filling operations.

Thus the new filler product supply apparatus and method of the present invention achieves the above stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function, and shall not be limited to the structures shown herein or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

We claim:

1. An apparatus for delivering fluid filler product to one or more containers, the apparatus comprising:

a filler product reservoir;

at least one conduit in fluid communication with the filler product reservoir;

a manifold in fluid communication with the conduit;

at least one filling head in fluid communication with the manifold and integral with the manifold, and wherein the filling head delivers filler product to a container.

2. The apparatus of claim 1 wherein the filler product reservoir, the conduit, the manifold and the filling head are pressurized.

3. The apparatus of claim 2 wherein the pressure is up to 25 psi.

4. The apparatus of claim 2 wherein the conduit is a hose.

5. The apparatus of claim 1 and further comprising a column wherein the conduit and manifold are in supported relation with the column.

6. The apparatus of claim 5 wherein the manifold is an annulus.

7. The apparatus of claim 6 wherein the manifold is concentric with the column.

8. The apparatus of claim 7 and further comprising at least one spoke wherein a first end of the spoke is in supported relation with the center column and a second end of the spoke is in supporting relation with the manifold.

9. The apparatus of claim 6 wherein the manifold comprises an upper portion and a lower portion, the upper portion and lower portion in mechanically pressure tight connection.

10. The apparatus of claim 9 wherein a gasket is disposed between the manifold upper portion and the manifold lower portion.

11. The apparatus of claim 1, wherein the manifold has at least one filling head aperture, and wherein at least a portion of the filling head passes through the aperture.

12. The apparatus of claim 11, wherein the portion of the filling head passes through the manifold.

13. The apparatus of claim 12, further comprising plural filling heads in fluid communication with the manifold.

14. The apparatus of claim 1, further comprising plural conduits, the conduits being intermediate the reservoir and the manifold.

15. The apparatus of claim 14, further comprising plural filling heads, the filling heads being in fluid communication with the manifold.

16. The apparatus of claim 15, further comprising a turret in supporting relation with a center column, wherein the manifold and the filling heads are in supporting relation with the turret.

17. The apparatus of claim 15, further comprising a column, wherein the manifold is in supported relation with the column, and wherein the manifold is concentric with the column.

18. The apparatus of claim 17, further comprising a plurality of spokes, wherein a first end of each plurality of spokes is in supported relation with the column and a second end of each plurality of spokes is in supporting relation with the manifold.

19. The apparatus of claim 15, wherein the manifold comprises an upper portion and a lower portion, the upper portion and lower portion in pressure tight connection.

20. The apparatus of claim 19, further comprising a gasket, wherein the gasket is disposed between the manifold upper portion and the manifold lower portion.

* * * * *